US009981795B2

(12) United States Patent
Stoffers et al.

(10) Patent No.: US 9,981,795 B2
(45) Date of Patent: May 29, 2018

(54) CONTAINER FOR ASEPTIC CONTENT

(71) Applicant: NESTEC S.A., Vevey (CH)

(72) Inventors: Niels Stoffers, Biglen (CH); Lutz Ellmann, Oberdiessbach (CH)

(73) Assignee: Nestec S.A., Vevey (CH)

( * ) Notice: Subject to any disclaimer, the term of this patent is extended or adjusted under 35 U.S.C. 154(b) by 210 days.

(21) Appl. No.: 14/770,513

(22) PCT Filed: Mar. 4, 2014

(86) PCT No.: PCT/EP2014/054195
§ 371 (c)(1),
(2) Date: Aug. 26, 2015

(87) PCT Pub. No.: WO2014/135552
PCT Pub. Date: Sep. 12, 2014

(65) Prior Publication Data

US 2016/0031623 A1 Feb. 4, 2016

(30) Foreign Application Priority Data

Mar. 6, 2013 (EP) ..... 13158030

(51) Int. Cl.

| | |
|---|---|
| ***B65D 53/00*** | (2006.01) |
| ***B65D 79/00*** | (2006.01) |
| ***A61J 1/14*** | (2006.01) |
| ***A61J 1/18*** | (2006.01) |
| ***B65B 3/04*** | (2006.01) |
| ***B65B 7/16*** | (2006.01) |
| ***B65B 7/28*** | (2006.01) |

(52) U.S. Cl.
CPC ..... *B65D 79/005* (2013.01); *A61J 1/1418* (2015.05); *A61J 1/18* (2013.01); *B65B 3/04* (2013.01); *B65B 7/168* (2013.01); *B65B 7/2835* (2013.01)

(58) Field of Classification Search
CPC ..... B65D 79/005; B65D 79/02; A61J 1/00; A61J 1/14; A61J 1/1412; A61J 1/1418; A61J 1/18
See application file for complete search history.

(56) References Cited

U.S. PATENT DOCUMENTS

| | | | | | |
|---|---|---|---|---|---|
| 2,040,798 | A * | 5/1936 | Schoonmaker | B65D 79/005 | 116/200 |
| 2,449,014 | A * | 9/1948 | Shaffer | B65D 51/145 | 116/200 |
| 3,833,142 | A * | 9/1974 | Owen | B65D 41/20 | 215/337 |
| 4,122,964 | A * | 10/1978 | Morris | B65D 51/145 | 215/200 |
| 4,721,219 | A * | 1/1988 | Dullabaun | B65D 79/005 | 215/230 |
| 4,747,497 | A * | 5/1988 | Holman | B65D 79/005 | 215/230 |

(Continued)

FOREIGN PATENT DOCUMENTS

WO 2013006927 1/2013

*Primary Examiner* — Steven A. Reynolds
*Assistant Examiner* — Javier A Pagan
(74) *Attorney, Agent, or Firm* — K&L Gates LLP

(57) ABSTRACT

The present invention relates to a container equipped with a closure system particularly adapted for aseptically filled fluid contents. The invention also relates to the use of said container in a method for detecting spoilage of its fluid content.

5 Claims, 2 Drawing Sheets

(56) References Cited

U.S. PATENT DOCUMENTS

| | | | | | |
|---|---|---|---|---|---|
| 4,765,498 | A | * | 8/1988 | Rafferty | B65D 79/005 215/230 |
| 4,877,143 | A | * | 10/1989 | Travisano | B65D 55/066 116/270 |
| 5,240,131 | A | * | 8/1993 | Keller | B65D 79/005 215/230 |
| 2008/0083693 | A1 | | 4/2008 | Gottlieb et al. | |

* cited by examiner

DETAIL D2

DETAIL D1

CONTAINER FOR ASEPTIC CONTENT

CROSS REFERENCE TO RELATED APPLICATIONS

The present application is a National Stage of International Application No. PCT/EP2014/054195, filed on Mar. 4, 2014, which claims priority to European Patent Application No. 13158030.0, filed on Mar. 6, 2013, the entire contents of which are being incorporated herein by reference.

FIELD OF THE INVENTION

The present invention relates to a container equipped with a closure system particularly adapted for aseptically filled fluid contents. The invention also relates to the use of said container in a method for detecting spoilage of its fluid content.

BACKGROUND OF THE INVENTION

There is a need for containers allowing detection of spoilage of the packaged fluids during storage. It would further be desirable to detect spoilage using non-destructive methods and without opening the package. Such methods would be even more advantageous for products which are aseptically filled such as nutritional or health care compositions or compositions intended for particularly sensitive people, such as for example infants.

DE 100 22 177 B4 discloses a means for signaling the state of a liquid contained in a bottle consisting of a cap having a transparent top and equipped with a flexible membrane that is deflected when the container is closed due to the internal pressure present in the bottle and subsequently in a flat position after the bottle has been opened. The visual aspect of the top surface of the membrane is different when the flexible membrane is deflected from the visual aspect of said upper surface of the flexible membrane when it is in a flat position, thus allowing visual identification of the state of the content. The system described in this document is mainly useful for bottles containing carbonated beverages which create a higher pressure inside the container than outside when the bottle is closed and the content is carbonated (deformed membrane), whereas the membrane is flat when the liquid is de-carbonated or the container has been opened. However, this cap is not suitable for aseptically filled content and is therefore not suitable to solve the above problem.

SUMMARY OF THE INVENTION

In a first aspect, the invention relates to a container, the content of which is an aseptic fluid, equipped with a closure system comprising a removable flexible foil (1) sealed to container opening (2) and further comprising a removable cap (4) adapted to the container over the flexible foil, characterized in that said removable cap is adapted such as creating a headspace (3) between at least part of said foil and the inner surface (6) of the top of the cap and in that said foil can deflect under the effect of pressure increase in said container.

In another aspect, the invention relates to the use of a container of the invention in a method for detecting spoilage of its content, characterized in that said method comprises the step of detecting the deflection of the flexible foil.

In a further aspect the invention relates to a method for the production of a container according to the invention, characterized in that said method comprises the steps of a. filling a container aseptically with an aseptic fluid
b. sealing the container opening with a removable flexible foil
c. adapting a removable cap to the container opening over said flexible foil such as creating a headspace (3) between at least part of the surface of said foil and the inner surface (6) of the top of the cap and such as allowing said foil to deflect under the effect of pressure increase in said container.

BRIEF DESCRIPTION OF THE DRAWINGS

FIG. 1 is a graphical representation of the container of Example 1. The upper part of the container is shown with the closure system of the invention.

FIG. 2 is a graphical representation of the container of Example 2. The upper part of the container is shown with the closure system of the invention.

DETAILED DESCRIPTION OF THE INVENTION

Figure 1A:
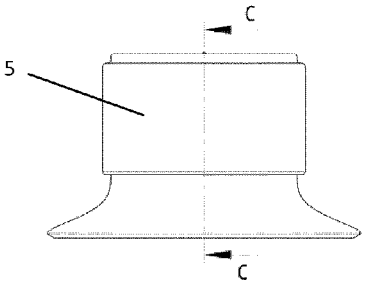
FIG. 1A shows a top view of the upper part of the closed container.

The present inventors have now developed a closure system specifically designed for aseptically filled containers. This closure system allows for non-destructive detection of spoiled fluid content.

The closure system is provided with the combination of a cap having a headspace extending over the top of the container opening and a foil sealed on said top of the container opening, as is evident from the drawings. Such closure system is particularly advantageous in that it allows for a clear detection of two different states of the content of the container: the aseptic and the spoiled states. In the aseptic state, the foil is either flat (pressure is the same inside and outside the container) or the foil is deflected towards the interior of the container (pressure lower inside the container than outside). In the spoiled state, the foil is deflected above the top of the container opening towards the exterior of the container and thus extends into the headspace. For the purpose of the invention, the wording "headspace (3) between at least part of the surface of said foil and the inner surface (6) of the top of the cap" is therefore meant as a headspace that is present between the foil and the top of the cap when the container is in the aseptic state such s to allow deflection of the foil upon spoilage of the content of the container. It is important that the headspace extends above the top of the container opening to ensure that the foil can deflect under the effect of spoilage even in containers designed to have the same pressure inside and outside the container in the aseptic state.

In a first aspect, the present invention provides a container, the content of which is an aseptic fluid, equipped with a closure system comprising a removable flexible foil (1) sealed to container opening (2) and further comprising a removable cap (4) adapted to the container over the flexible foil, characterized in that said removable cap is adapted such as creating a headspace (3) between at least part of said foil and the inner surface (6) of the top of the cap and in that said foil can deflect under the effect of pressure increase in said container.

The flexible foil is hermetically sealed to the container opening, so as to protect the aseptic fluid content from contaminants present in the environment. Despite the presence of the foil, spoilage of the content can still happen, e.g. due to incomplete sterilisation of packaging material or product. Spoilage of the fluid content of the product is caused by growth of microorganisms, such as bacteria or fungi (e.g. yeast or moulds) being accidentally present in said product thus forming gas. The foil being hermetically sealed on the container opening, gas formed in the container by the content spoilage cannot escape from the container. Therefore, an increase in the pressure inside the container is observed, thus leading to deflection of the flexible foil. Measurement of the flexible foil deflection can therefore be used as a means for identifying spoilage. In the present invention, the foil thus has the double usefulness of helping preservation of the fluid content of the container and of acting as a spoilage indicator.

The flexible foil can be made of any flexible material that is not permeable to gas. The resistance of the material must also be sufficient to avoid rupture under the effect of the pressure changes in the container. In a preferred embodiment, the foil is made of a layered material, such as a laminate, comprising at least one aluminium layer. The presence of an aluminium layer is particularly advantageous in that it eases detection of the foil deflection and even allows detection of the foil deflection without removing the plastic cap. For example, inductive proximity detection methods render it possible to detect a foil comprising a metal layer such as an aluminium layer through a plastic cap.

The foil must be applied in a removable way to the container opening so that the final consumer can open the container before consumption. However, the foil must be sealed in a sufficiently strong way to avoid any rupture of the seal under the effect of pressure changes in the container, which would lead to inefficacy of the protective and of the spoilage indicator function of the foil. In a preferred embodiment, the flexible foil is glued or thermally sealed to the container opening. Using a flexible foil comprising a sealing layer with high affinity to the bottle material enables it to be easily sealed to the container opening by applying heat. Therefore the flexible foil is preferably a laminate comprising at least one aluminium layer and at least one sealing layer with high affinity to the material of which the container opening is made.

In a preferred embodiment, the normal pressure in the container in the aseptic state (i.e. when the fluid content is aseptic) is lower than ambient pressure, so that the aluminium foil extends towards the inside of the container. This stretches the flexible foil and thus renders its surface even and regular. This is advantageous in that it eases precise and reliable detection of any deflection of the foil when the content is spoiled. Irregular surface of the flexible foil can indeed lead to inaccurate spoilage detection. For example there is a risk that an irregularity of the foil extending to the headspace is detected as a deflection resulting from spoilage, which could lead to packages with clean content being put aside and thus to unnecessary waste.

According to a preferred embodiment of the invention, the cap is further provided with at least one means for evacuation of the gas present in the headspace (3) between the foil (1) and the inner surface (6) of the top of the cap, such as air. This feature is advantageous in particular because it eases the deflection of the flexible foil under the effect of pressure increase in the container, since such deflection does not require compression of the gas present in the headspace. In a preferred embodiment said means for evacuation of the gas present the headspace comprises at least one orifice.

Any type of cap can be used. Preferably, it is a screw cap. The cap is shaped so as to prevent the inner surface of the cap from entering into contact with the flexible foil in the aseptic state. This can be achieved for example by providing the cap with a bulge or concavity on its inner wall that prevents the inner surface of the cap from entering into contact with the flexible foil. So as to ease the deflection of the foil under the effect of pressure increase in the container, the headspace is preferably extending over substantially the whole surface of the flexible foil that is not sealed to the container opening. Preferably the height of the headspace is such that the flexible foil can fully deflect under the effect of the inner pressure increase. Full deflection shall be understood for the purpose of the present invention as the maximum deflection of the foil towards the exterior of the container, taking into account the flexibility of the foil, while avoiding rupture of the foil.

The container of the present invention is intended for aseptic fluids, i.e. any fluid product that has been aseptically filled into the container. For the purpose of the present invention, aseptic filling has its usual meaning in the art, i.e. filling of a sterile (aseptic) product in an aseptic container in a way that maintains sterility of the interior of the container, including the product. Aseptic filling is very different from for example hot filling or retort process. Aseptic filling involves sterilisation of the product, followed by filling in the container at room temperature and no post-filling heat treatment is required. This filling process leads to safer product having superior quality due to shorter heat exposure. The material from which the container is made is preferably provided with barrier properties suitable to prevent spoilage of aseptically filled products, such as oxygen and/or light barrier properties.

Such products are advantageously food products or beverages. In a preferred embodiment, such product is a nutritional product or a health care product and even more preferably an infant formula.

In another aspect the invention provides for the use of a container in a method for detecting the spoilage of its aseptically filled fluid content, characterized in that said container is equipped with a closure system comprising a removable flexible foil (1) sealed to container opening (2) and further comprising a removable cap (4) adapted to the container over the flexible foil such as creating a headspace (3) between at least part of said foil and the inner surface (6) of the top of the cap, so that the foil is allowed to deflect under the effect of pressure increase in said container and further characterized in that said method comprises the step of detecting the deflection of the flexible foil.

In other words, the invention relates to a method for detecting the spoilage of the aseptically filled content of a container equipped with a closure system comprising a removable flexible foil (1) sealed to the container opening (2) and further comprising a removable cap (4) adapted to the container over the flexible foil, such as creating a headspace (3) between at least part of said foil and the inner surface (6) of the top of the cap, so that the foil is allowed to deflect under the effect of pressure increase in said container, wherein said method comprises detection of the deflection of the flexible foil.

The detection of the deflection of the flexible foil is preferably carried out by a proximity detection method, more preferably while maintaining the cap in place. The phrase "proximity detection method" has its general meaning in the art, i.e. a method for the detection of the presence of nearby objects without any physical contact using a proximity sensor. Proximity sensors can work using diverse mechanisms. The optimal proximity detection method highly depends on the nature of the object to be detected and more particularly depends on the material of which such object is made. Proximity sensors suitable for detection of aluminium are preferred for the purpose of the present invention (e.g. inductive sensors). The detection is carried out by pointing the detector towards the headspace so that the presence of the foil in the headspace can be detected. To be noted that the detection method would not be efficient if there were no headspace as described herein because the detector could not distinguish the aseptic state from the spoiled state.

In a preferred embodiment the spoilage detection method further comprises an incubation step. Spoilage of the fluid content of the product is caused by growth of microorganisms, such as bacteria or fungi (e.g. yeast or moulds) being accidentally present is said product. Gas will thus be formed and cause pressure increase in the container and deflection of the flexible foil. Microorganisms present in the fluid product grow naturally when the product is stored between the time the container is filled and the time of product consumption. The incubation step can thus consist of storage of the product during a few days, weeks, months or years, depending on the product, under prescribed storage conditions such as for example ambient temperature and pressure. Alternatively the incubation conditions can be adapted to mimic normal storage within a shorter period of time. In such cases, temperatures higher than ambient temperatures and typically comprised between 30 and 45° C. are used. Temperatures such as 37° C., 40° C. or 42° C. are for example suitable depending on the type of bacteria and/or fungi involved in the product spoilage. At such temperatures, the incubation time is typically comprised between 48 hours and 7 days.

The container of the present invention can be produced by carrying out a method comprising the following steps:

a. aseptically filling a container with a fluid product;
b. sealing the container opening with a removable flexible foil (1); and
c. adapting a removable cap (4) to the container opening (2) over said flexible foil (1) such as creating a headspace (3) between at least part of the surface of said foil (1) and the inner surface (6) of the top of the cap and such as allowing said foil to deflect under the effect of pressure increase in said container.

The container, the aseptically filled product, the flexible foil and the cap are preferably as defined in any of the preferred embodiments of the invention described above.

The present invention will now be described in further details by the way of the following examples.

EXAMPLE 1

Figure 1B:
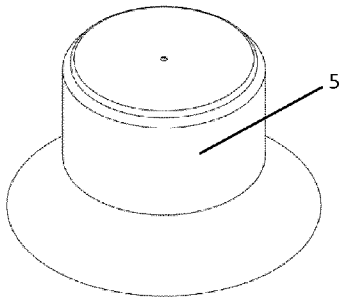
FIG. 1B shows a side view of the upper part of the closed container.
Figure 1C:
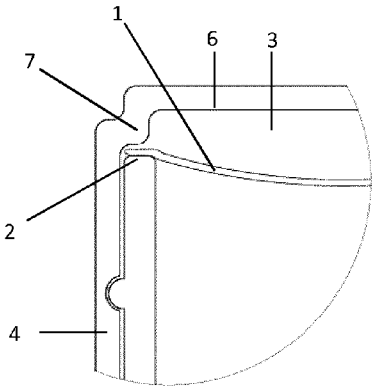
FIG. 1C shows a section view of the closed container when the content is aseptic. The flexible foil (1) adheres to the top of the container opening (2). The pressure in the container is lower than in the environment, so that the foil is bent in a downward position, towards the interior of the container. A screw cap (4) is adapted to the container opening. The bending (7) of the screw cap wall ensures that a headspace (3) is left between the foil (1) and the inner surface (6) of the top of the cap (4) above the top of the container opening (2).
Figure 1C:
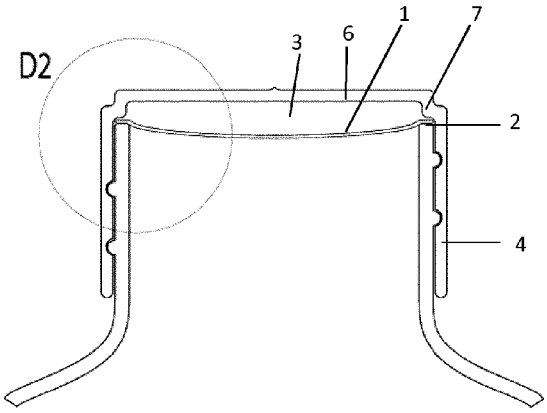
Figure 1D:
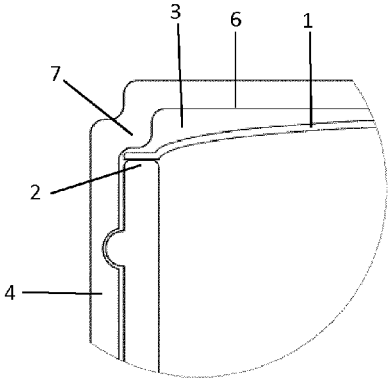
FIG. 1D shows a section view of the closed container when the content is spoiled. Spoilage of the content increases the pressure inside the container, thus deflecting the flexible foil (1), which is now extending into the headspace (3) above the top of the container opening (2). The height of the headspace (3) is such that the flexible foil (3) can fully deflect under the effect of the inner pressure increase.
Figure 1D:
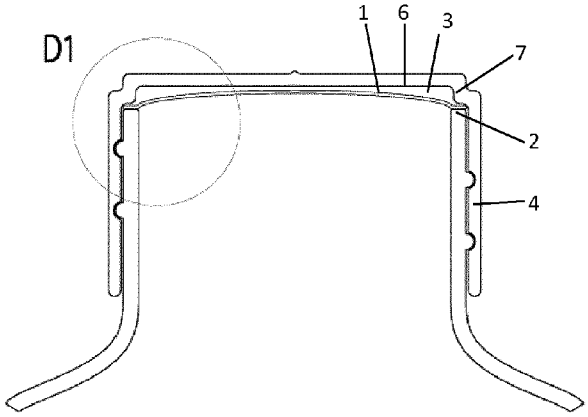

A liquid infant formula bottle was provided with the closure system of FIG. 1. The closure system allowed for deflection of the flexible foil into the headspace under the effect of pressure increase in the bottle when the liquid infant formula was spoiled. The closure system was provided with a screw cap (4) and with a flexible foil (1) made of a laminated material comprising an aluminium layer.

EXAMPLE 2

Figure 2A:
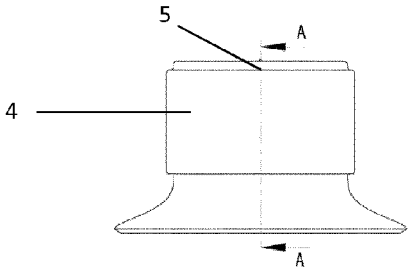
FIG. 2A shows a top view of the upper part of the closed container.
Figure 2B:
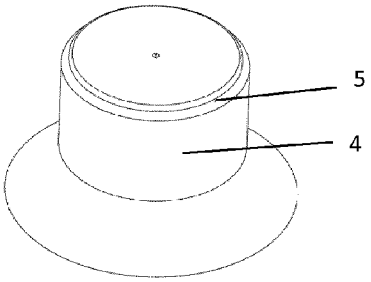
FIG. 2B shows a side view of the upper part of the closed container.
Figure 2C:
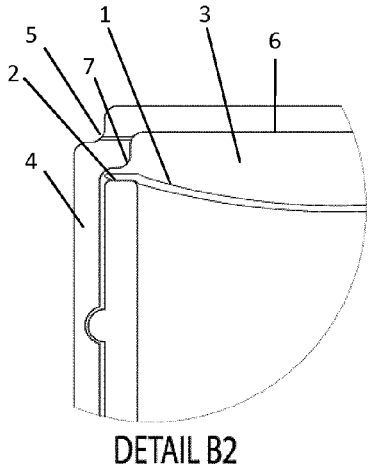
FIG. 2C shows a section view of the closed container when the content is aseptic. The flexible foil (1) adheres to the top of the container opening (2). The pressure in the container is lower than in the environment, so that the foil is bent in a downward position, towards the interior of the container. A screw cap (4) is adapted to the container opening. The bending (7) of the screw cap wall ensures that a headspace (3) is left between the foil (1) and the inner surface (6) of the top of the cap (4) above the top of the container opening (2).
Figure 2C:
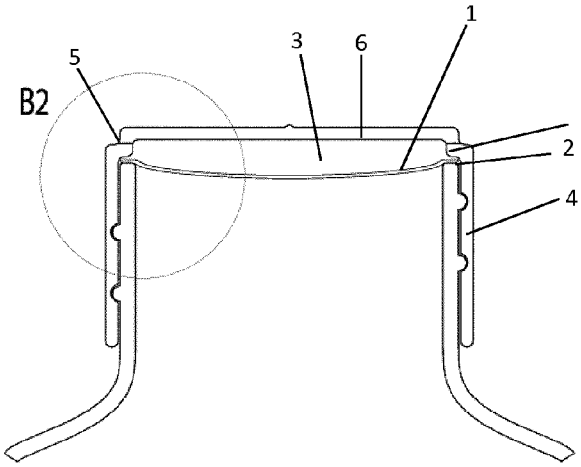
Figure 2D:
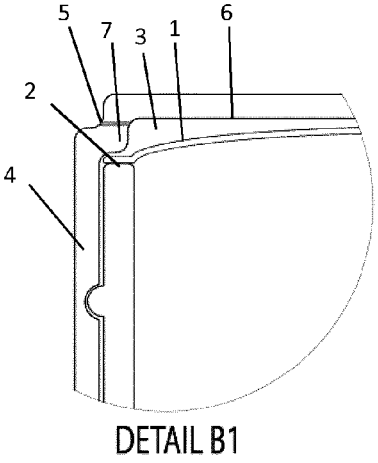
FIG. 2D shows a section view of the closed container when the content is spoiled. Spoilage of the content increases the pressure inside the container, thus deflecting the flexible foil (1), which is extending in the headspace (3) above the top of the container opening (2). The height of the headspace (3) is such that the flexible foil (1) can fully deflect under the effect of the inner pressure increase. To ease deflection of the foil (1), a means for evacuation of the air present in the headspace (3) is provided by the orifice (5).
Figure 2D:
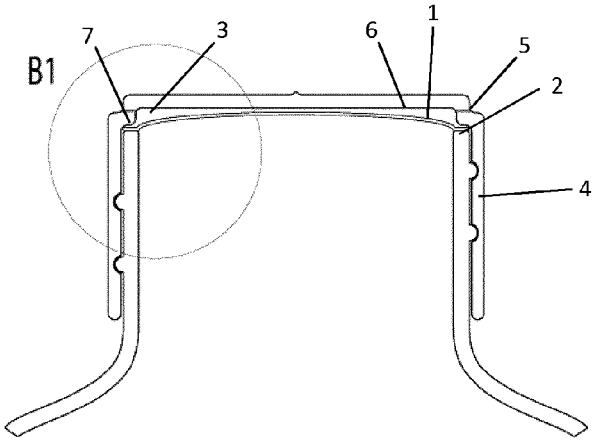

An infant formula bottle was provided with the closure system of FIG. 2. The closure system allowed for deflection of the flexible foil into the headspace under the effect of pressure increase in the bottle when the infant formula was spoiled. The closure system was provided with a screw cap (4) and with a flexible foil (1) made of a laminated material comprising an aluminium layer.

EXAMPLE 3

The spoilage of the liquid infant formula contained in a batch of bottles of examples 1 and a batch of bottles of example 2 was analysed by detecting the deflection of the foil (1) in the headspace (3) by proximity detection using an inductive sensor after 1 month storage at room temperature. In addition two sets of control bottles were tested (one set of bottles in the aseptic state and one set of bottles in the spoiled state. The sensor was placed on the side of the bottles in such a way that the headspace (3) above the mouth of the container was in the detection area of said sensor. All bottles were tested without removing the screw cap. Results of the detection were checked by visual examination of the bottles. This confirmed that the spoilage detection method was successful in distinguishing the bottles in the spoiled state from the ones in aseptic state.

The invention claimed is:

1. A method for detecting spoilage of an aseptically filled content of a container equipped with a closure system comprising a removable flexible foil sealed to a top of walls of the container that define a container opening, the closure system further comprising a removable cap adapted to the container over the removable flexible foil to create a headspace between at least part of a surface of the removable flexible foil and an inner surface of a top of the removable cap, so that the removable flexible foil is allowed to deflect above the top of the walls defining the container opening, toward an exterior of the container and extending into the headspace under the effect of a pressure increase in the container, the method comprising detecting the deflection of the removable flexible foil.

2. The method according to claim 1, wherein the detecting of the deflection of the removable flexible foil is carried out by proximity detection.

3. The method according to claim 2, wherein the proximity detection comprises pointing a proximity detector towards the headspace and detecting the presence of the foil in the headspace.

4. The method according to claim 3, wherein the proximity detector comprises an inductive sensor.

5. The method according to claim 1, wherein a first pressure inside the container is lower than a second pressure outside of the container.

* * * * *